US010472130B2

(12) United States Patent
Foster

(10) Patent No.: US 10,472,130 B2
(45) Date of Patent: Nov. 12, 2019

(54) BUCKET HANDLE ASSEMBLY

(71) Applicant: Norman Foster, St. Louis, MO (US)

(72) Inventor: Norman Foster, St. Louis, MO (US)

( * ) Notice: Subject to any disclaimer, the term of this patent is extended or adjusted under 35 U.S.C. 154(b) by 233 days.

(21) Appl. No.: 15/364,850

(22) Filed: Nov. 30, 2016

(65) Prior Publication Data

US 2017/0158376 A1 Jun. 8, 2017

Related U.S. Application Data

(60) Provisional application No. 62/262,554, filed on Dec. 3, 2015, provisional application No. 62/297,413, filed on Feb. 19, 2016.

(51) Int. Cl.
*B65D 25/32* (2006.01)

(52) U.S. Cl.
CPC ..... *B65D 25/32* (2013.01); *B65D 2525/285* (2013.01)

(58) Field of Classification Search
CPC ..... B65D 25/32; B65D 2525/285
USPC ..... 220/755, 773, 760
See application file for complete search history.

(56) References Cited

U.S. PATENT DOCUMENTS 4,365,725 A 12/1982 Pfeifer
4,896,415 A * 1/1990 Bock ..... B29C 49/00 220/760
5,445,425 A 8/1995 Lyver
5,816,439 A 10/1998 Lovell et al.
6,352,169 B2 3/2002 Foster
7,780,036 B2 * 8/2010 Splain ..... A45C 13/26 206/505
2006/0289711 A1 12/2006 Wilschut et al.

OTHER PUBLICATIONS

International Search Report from corresponding International application PCT/US2017/018392 dated Jul. 19, 2017.
Written Opinion from corresponding International application PCT/US2017/018392 dated Jul. 19, 2017.

* cited by examiner

*Primary Examiner* — Anthony D Stashick
*Assistant Examiner* — James M Van Buskirk
(74) *Attorney, Agent, or Firm* — Sandberg Phoenix & von Gontard P.C.

(57) ABSTRACT

A handle and assembly for a bucket. The bucket has first and second attachment regions on the inner surface of the sidewall near the rim. The sidewall has a compressed condition in which compressive forces are applied to opposite sides to reduce the distance between the attachment regions, and a relaxed condition with forces. The handle has attachment ends with an axis between them. The attachment ends attach to the attachment regions such that the handle rotates about the axis and can also move laterally along the axis. The handle has a first rotational position in which the handle is above the rim, and a second rotational position in which the handle is below the rim. The handle cannot rotate between the first and second positions when the sidewall is relaxed, but can when the sidewall is laterally compressed.

11 Claims, 9 Drawing Sheets

BUCKET HANDLE ASSEMBLY

CROSS REFERENCE TO RELATED APPLICATIONS

This application derives and claims priority from U.S. provisional application 62/262,554 filed Dec. 3, 2015 and U.S. provisional application 62/297,413 filed Feb. 19, 2016, both of which U.S. provisional applications are incorporated herein by reference.

STATEMENT REGARDING FEDERALLY SPONSORED RESEARCH OR DEVELOPMENT

Not applicable.

BACKGROUND OF THE INVENTION

The invention is related generally to buckets or pails and, more specifically, to an improved handle and handle assembly comprising the handle and an associated attachment apparatus, the attachment apparatus designed for connecting the handle to a bucket or pail, particularly a bucket used by window cleaners on high-rise buildings.

Buckets or pails with handles are known to the art. However, those persons employed as window cleaners or window washers on high rise buildings use buckets containing cleaning liquid or water that must meet certain requirements of the trade. The window washer generally is seated in what is known in the art as a "boatswain chair". The high-rise window washer accesses windows by swing stage or boatswain chair. The two systems that use the boatswain chair are the Manual Boatswain Chair and the Control Descent System. The Manual Boatswain Chair system uses block and tackle to raise or lower the window washer to the windows. The Control Descent System uses gravity by starting at the roof and rappelling over the side. The rate of descent is controlled using a descent device. The descent device regulates the movement down the rope by way of friction. The window washer can descend down to the window and then lock the device until ready to descend to the next window. In most cases, the window washer hangs his bucket on one or more snap hooks suspended from the side of the boatswain chair so that the bucket is readily accessible.

Prior art buckets typically used for hanging on a boatswain chair have several drawbacks. First, to keep the weight down, the buckets usually are plastic with thin, flexible wire handles. The bucket is attached to the boatswain chair by fastening the wire handle onto a single snap hook, or to double snap hooks on the boatswain's chair. A conventional wire handle can shift or slide along a single snap hook and tip or spill. With double snap hooks, the normal arc of the wire handle must be distorted to fasten to the snap hooks. Furthermore, the weight of the liquid in the bucket can cause the handle to pull out or deform the handle or cause the plastic to crack and fail around the handle. Since conventional handles are mounted on the outside of the bucket, the weight of the liquids in the bucket can cause the sides of the bucket to collapse inwardly at the points where the handle is mounted to the bucket.

It is possible with a properly designed bucket handle and centered snap hook to suspend a bucket from the single snap hook in a manner that eliminates the sliding, tipping and spilling from the bucket that is especially dangerous to window washers and bystanders below the washer. U.S. Pat. No. 6,352,169 describes a rigid, inverted V-shaped handle made of aluminum rod for use with double sling chairs. The V-shaped handle is mounted on a bucket and configured so that the bucket is suspended from a snap hook, which is fastened to the V-shaped handle at the apex of the inverted V-shape. The rigid construction and V-shaped configuration of the handle prevents the sliding and tipping of the bucket that occurs when the standard wire handle is used for suspension from the single snap hook.

However, the bucket handle design of U.S. Pat. No. 6,352,169 and similar designs require that the handle be secured to the bucket with a nut and threaded shaft configuration that adds machining and assembly costs. In addition, these configurations require means to ensure that the nut does not loosen or fall free from the handle, which could cause the bucket to tip or spill during use.

Further, it is desirable for buckets being used in most applications and in particular for window washing buckets, that the bucket handle freely rotate about the bucket at the bucket mounts. This allows the bucket to rest at a natural equilibrium and eliminates the undesirable rotational torque to the handle and the bucket that would otherwise result from a bucket swinging from a handle rigidly attached to the bucket, or attached in a way that would hinder at least in part the free rotation of the bucket relative to the bucket. Unfortunately, the bucket handle design of U.S. Pat. No. 6,352,169 and similar designs hamper the rotation of the bucket relative to the handle at the handle mounts. A need therefore remains for an improved bucket handle design for window washer's buckets that is easier to assemble and therefore more cost effective to manufacture, and that allows the bucket handle to more freely rotate relative to the body of the bucket.

In addition, it is often desirable to secure a lid to the upper lid of a bucket that has a handle mounted to the inner surface of a bucket. Unfortunately, bucket handles that are attached to the inner surface of a bucket, such as for example the handle of U.S. Pat. No. 6,352,169, interfere with and preclude the placement and securing of a bucket lid to the bucket's upper lip. A need therefore remains for an improved bucket handle assembly design for window washer's buckets and buckets for other applications that is easier to assemble and therefore more cost effective to manufacture, and that allows the bucket handle to be positioned for ready access, yet also be storable within the bucket so as not to interfere with the placement of a lid atop the bucket's upper lip.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION OF THE INVENTION

Figure 1:
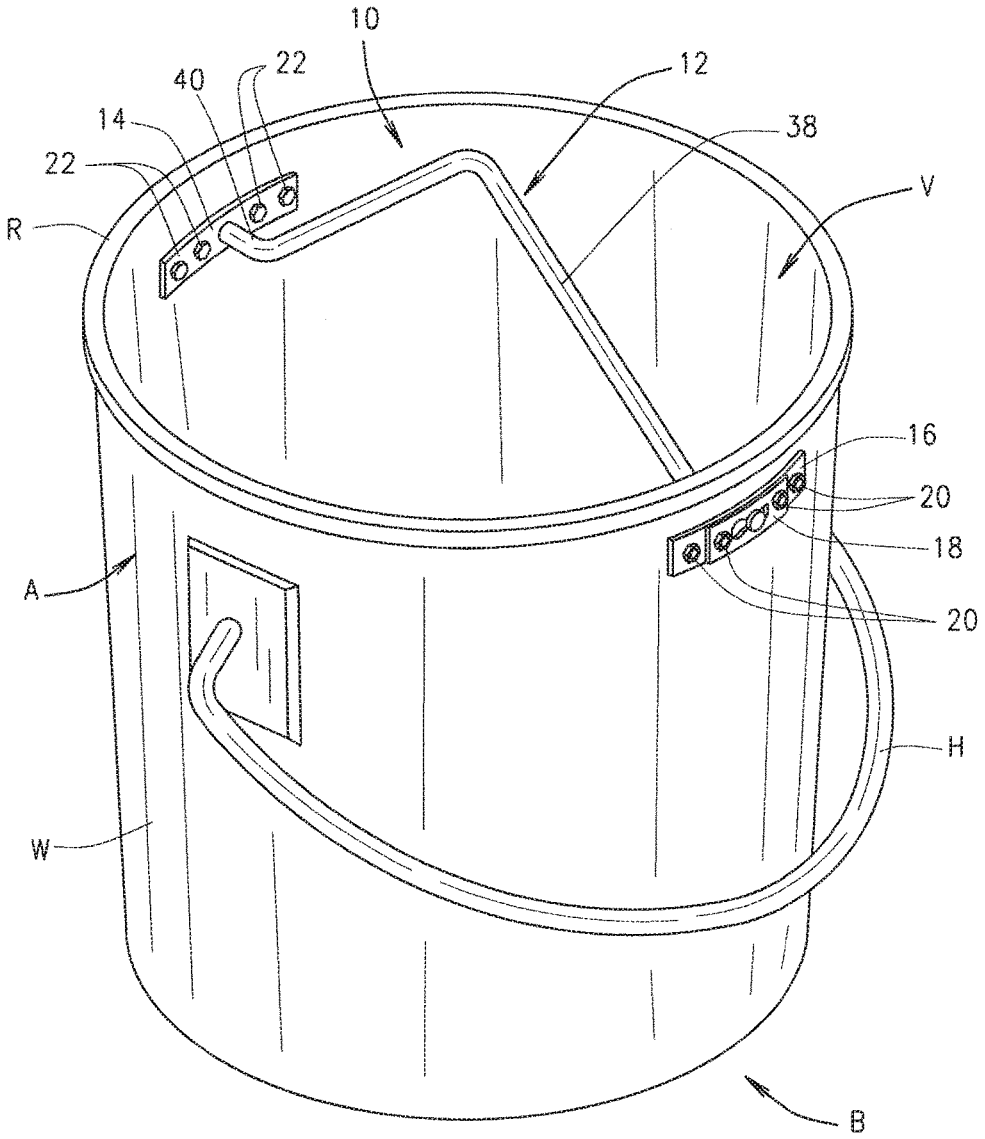
FIG. 1 is a perspective view of a first representative embodiment of the bucket handle and handle assembly of the present invention incorporated into a bucket.

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

In referring to the drawings, a first representative embodiment of the novel bucket handle assembly 10 of the present invention is shown generally in FIGS. 1-4, where the present invention is depicted by way of example incorporated into a bucket A. The bucket A can be virtually any type of bucket or pail. However, in many applications, bucket A will be a 5 gallon plastic pail such as those used for cleaning exterior windows of multi-story buildings, and which can be attached to scaffolding to facilitate such use. In any case, bucket A includes a circumferential sidewall W with a rim R forming a top edge, and a bottom B opposite the rim R. The bucket A can be cylindrical, as shown, or can be of other varying shapes, such as for example, square or rectangular, tapered or bulbous, so long as the bucket has a sidewall W to which the handle assembly 10 can be attached. In the depicted embodiment of the bucket A, the sidewall W is cylindrical. The circumferential wall W and the bottom B of the bucket A define the useful container portion of the bucket A, which will be referred to as the inner volume V. The bucket A may also include a traditional handle H attached to the outer surface of the sidewall W, as shown.

Figure 2:
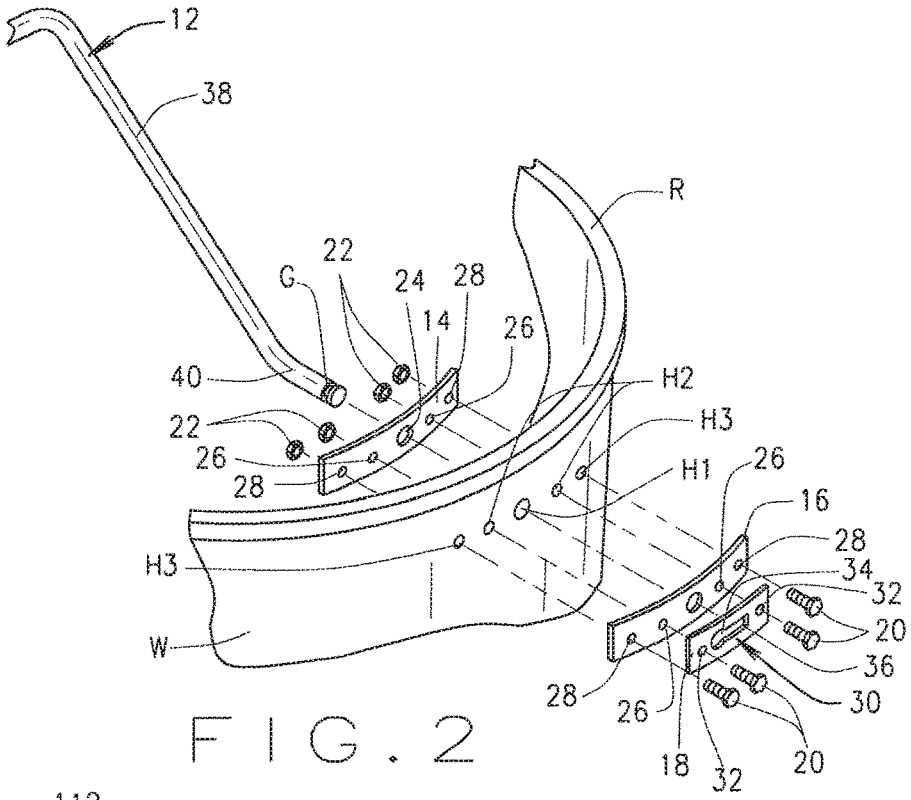
FIG. 2 is an exploded perspective view of a portion of the first representative embodiment of the bucket handle and handle assembly of FIG. 1 incorporated into a bucket.

Referring to FIGS. 1 and 2, on each side of the bucket A, a set of five circular orifices or holes H1, H2 and H3 are positioned near the rim R, with the holes H2 and H3 having the same diameter and holes H1 being somewhat larger in diameter. The holes H1, H2 and H3 are positioned on opposite sides of the bucket A at the upper end of the bucket A in proximity to and equidistant from the rim R such that the holes H1, H2 and H3 are oriented horizontally along a line just below and parallel to the rim R, with the holes H1 positioned substantially at the center of the line of holes, the first set of smaller holes H2 positioned on each side of and equidistant from the holes H1, and the second set of smaller holes H3 positioned further yet from the holes H1 and likewise equidistant there from.

In this first representative embodiment, the bucket handle assembly 10 comprises a rod-shaped handle 12, two rectangular inner mounting plates 14, two rectangular outer mounting plates 16, two rectangular slide plates 18, and four screws 20 and matching nuts 22 for securing the plates together and to the sidewall W of the bucket A when assembled (see FIG. 2). All of the plates 14, 16 and 18 are curved along their lengths to match the curvature of the sidewall W of the bucket A. Each of the mounting plates 14 and 16 has a set of five circular orifices 24, 26 and 28 formed therein, with the orifices 26 and 28 having the same diameter and orifice 24 being somewhat larger in diameter. For each of the plates 14 and 16, the orifices 24, 26 and 28 are oriented collinearly along the length of the centerline of the plate, with the orifices 24 positioned substantially at the center of the plate, the first set of smaller orifices 26 positioned on each side of and equidistant from the orifice 24, and the second set of smaller orifices 28 positioned further yet from the orifice 24 and likewise equidistant there from. The orifices 24, 26 and 28 are oriented to match the holes H1, H2 and H3 when the plates 14 and 16 are properly positioned over the sidewall W of the bucket A as shown.

Each of the slide plates 18 has a large keyhole orifice 30 positioned substantially in the center of the plate in a longitudinal orientation, and a single smaller circular orifice 32 on each side of the keyhole orifice 30. Each of the keyhole orifices 30 has a large circular head 34 of the same diameter as the large circular orifices 24 in the mounting plates 14 and 16, and a narrower linear slot 36 extending longitudinally or laterally away from the head 34. For each of the slide plates 18, the head 34, the linear slot 36 and the orifices 32 are all oriented collinearly along the length of the centerline of the plate, and the head 34 of the keyhole orifice 30 is oriented to align with the circular orifices 24 of the mounting plates 14 and 16 when the handle assembly 10 is fully assembled as shown. Likewise, the smaller orifices 32 are oriented to align with the first set of smaller orifices 26 of the mounting plates 14 and 16 when the handle assembly 10 is fully assembled as shown.

The handle 12 has a uniform, round cross-section, is replaceable on the bucket A, and is made from metal stock such as ⅜" (three eighths inch) aluminum rod. The handle 12 includes a generally "V" shaped central portion 38, and two matching attachment ends 40 that extend radially and coaxially in a horizontal fashion away from opposing sides of the central portion 38. A radial detent or groove G is formed near the distal end of each attachment end 40.

Each end of the handle 12 is removably mounted to the sidewall W of the bucket A using a matching set of each of the inner and outer mounting plates 14 and 16. The mounting plates 14 and 16 are positioned on each side of the sidewall W over their corresponding holes H1, H2 and H3, and fastened together with sets of screws 20 and nuts 22, with the sidewall W sandwiched between the mounting plates 14 and 16 and the holes H1, H2 and H3 aligned with their corresponding orifices 24 of both plates. Preferably, the holes H are positioned such that the upper end of the mounting plates 14 and 16 rest against, but do not extend above, the outer lip of the rim R when the handle assembly 10 is fully assembled as shown.

When the handle assembly 10 is property assembled on the bucket A as seen in FIGS. 1-4, the distal ends of the attachment ends 40 are inserted through their respective orifices 24 in the mounting plates 14 and the holes H in the sidewall W. The handle 12 has a length that slightly exceeds the outer diameter of the sidewall W of the bucket A, such that a small length of distal end of each of the attachment ends 40 projects past the outer mounting plates 16 such that the groove G is fully exposed outside of, but in near proximity to, the outer surface of the plate 16. When the handle 12 is thus positioned in the bucket A, the slide plate 18 can then be positioned over the outer mounting plate 16 with the head 34 of the keyhole orifice 32 aligned with the end of the attachment end 40 and the linear slot 36 in a horizontal orientation. The slide plate 18 is then pressed against the outer mounting plate 16 such that the linear slot 36 of the keyhole orifice 32 aligns with the groove G in the attachment end 40 against the outer surface of the outer mounting plate 16. It will be noted that with the plates in this position, the orifices 30 will not align with the orifices 26 and holes H2. Instead, it is necessary to slide the slide plate 18 laterally over the groove G until the orifices 30 do align with the orifices 26 and the holes H2. Sets of screws 20 and nuts 22 are then used to secure the slide plate 18 to the outer mounting plate 16 as shown. As can be appreciated, this configuration firmly secures the handle 12 to the bucket A, while allowing the handle 12 to rotate relatively freely about the axis defined by the attachment ends 40 and the holes H1.

Figure 6:
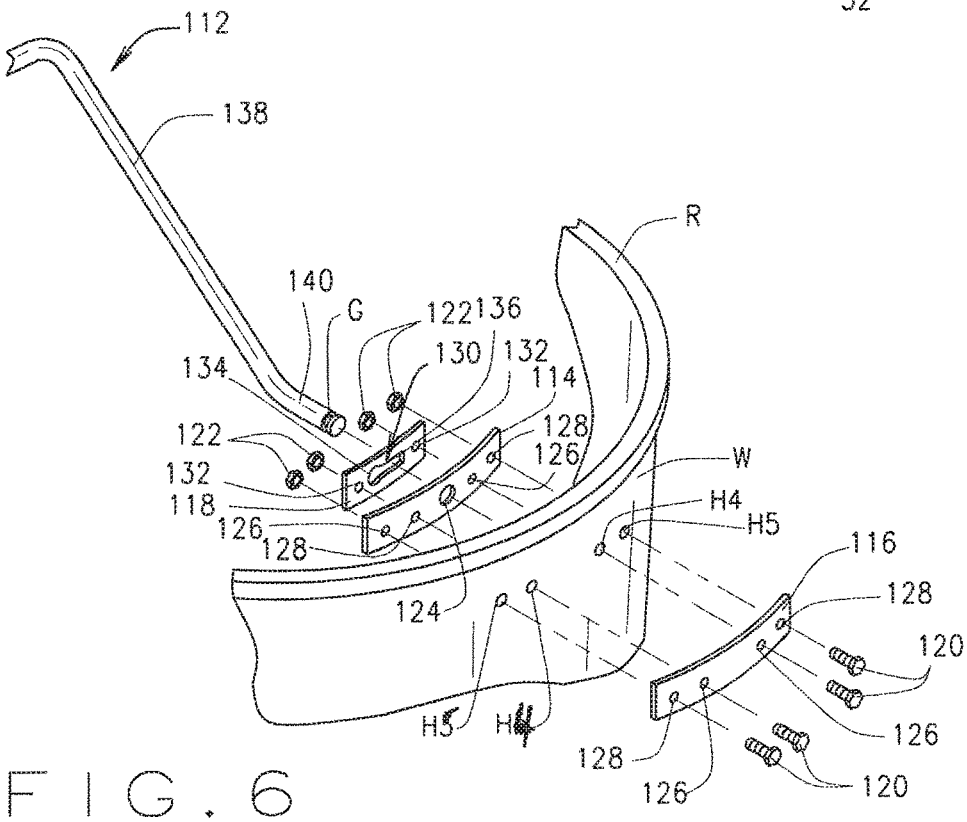
FIG. 6 is an exploded perspective view of the second representative embodiment of the bucket handle and handle assembly of FIG. 5 incorporated into a bucket.
Figure 3:
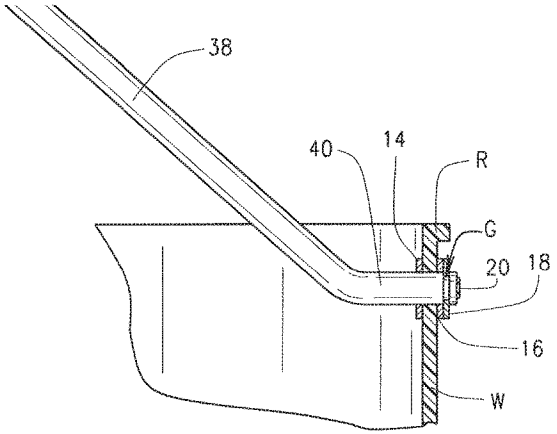
FIG. 3 is a partial cutaway plan view of one end of the first representative embodiment of the bucket handle and handle assembly of FIG. 1 incorporated into a bucket.
Figure 7:
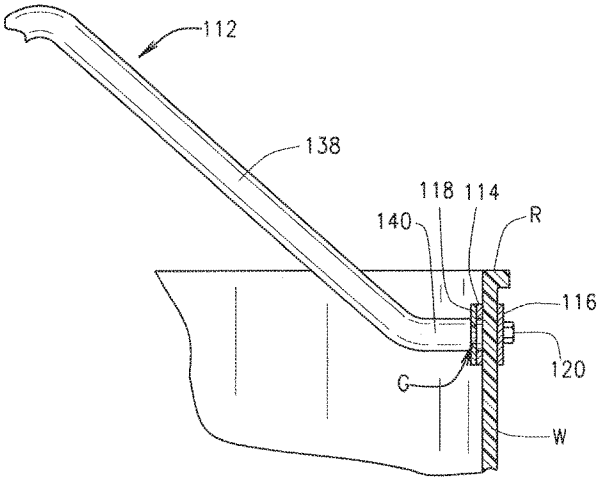
FIG. 7 is a partial cutaway plan view of one end of the second representative embodiment of the bucket handle and handle assembly of FIG. 5 incorporated into a bucket.
Figure 5:
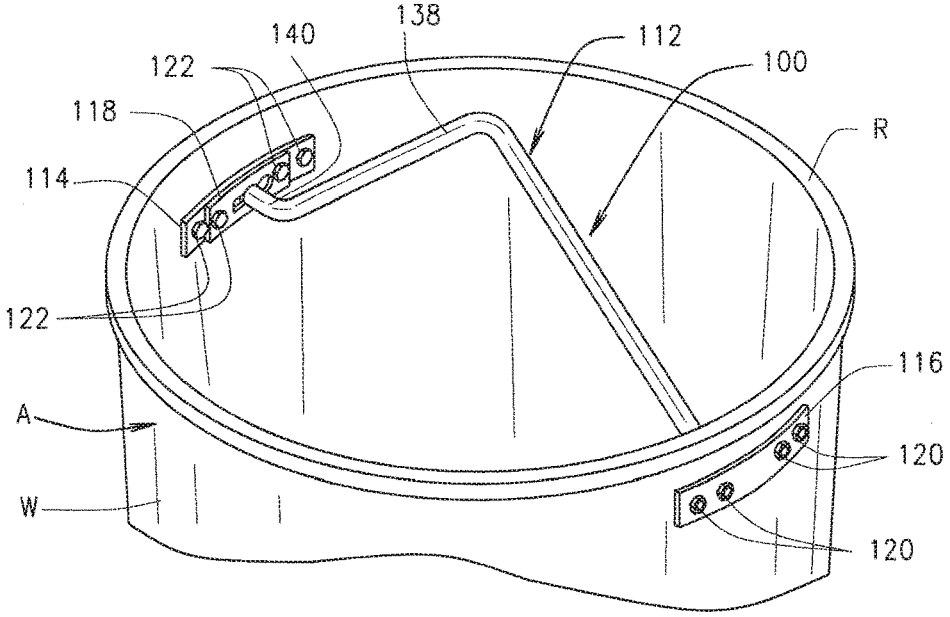
FIG. 5 is a perspective view of a second representative embodiment of the bucket handle and handle assembly of the present invention incorporated into a bucket.
Figure 4:
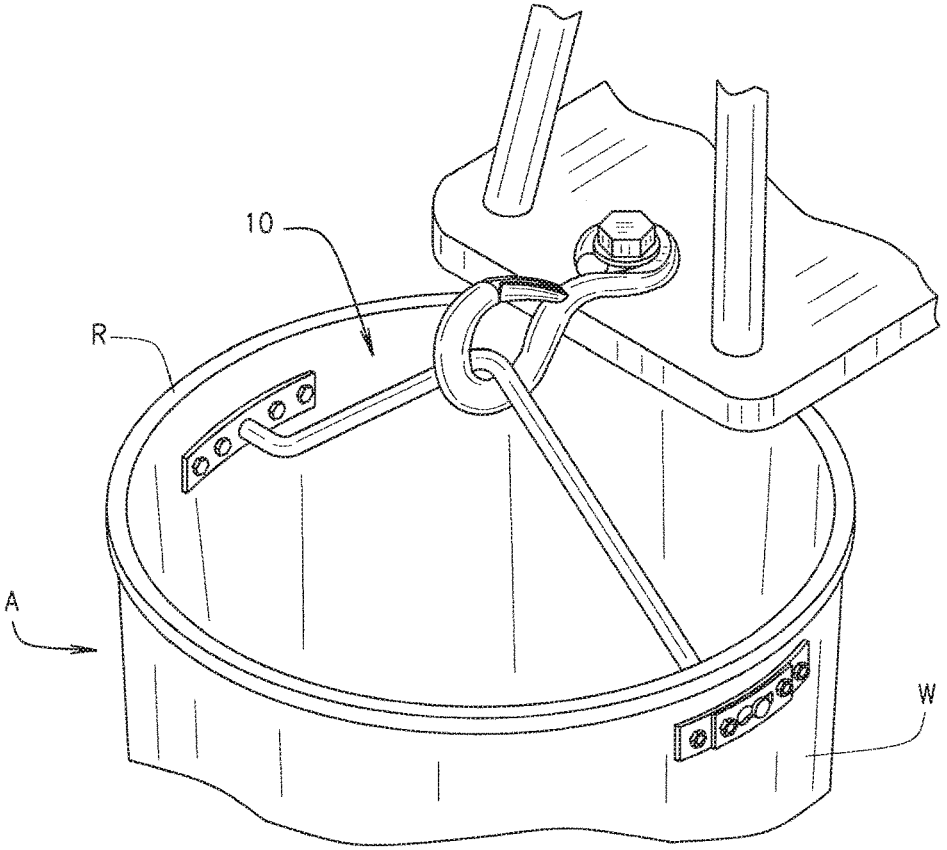
FIG. 4 is a perspective view of the upper portion of a bucket hanging from a scaffold, the bucket incorporating the first representative embodiment of the bucket handle and handle assembly of FIG. 1.

A second representative embodiment of the novel bucket handle assembly 100 of the present invention is shown generally in FIGS. 5-7, where the present invention is depicted by way of example incorporated into a bucket A. Referring to FIG. 6, it can be seen that on each side of the bucket A, a set of four circular orifices or holes H4 and H5 are positioned near the rim R, with the all of the holes H4 and H5 having the same diameter. The holes H4 and H5 are positioned at the upper end of the bucket A in proximity to and equidistant from the rim R such that the holes H4 and H5 are oriented horizontally along a line just below and parallel to the rim R, with the holes H5 positioned outside the holes H4 as shown.

In this second representative embodiment, the bucket handle assembly 100 also comprises a rod-shaped handle 112, two rectangular inner mounting plates 114, two rectangular outer mounting plates 116, two rectangular slide plates 118, and four screws 120 and matching nuts 122 for securing the plates together and to the sidewall W of the bucket A when assembled (see FIG. 6). All of the plates 114, 116 and 118 are curved along their lengths to match the curvature of the sidewall W of the bucket A.

The mounting inner plates 114 each have a set of five circular orifices 124, 126 and 128 formed therein, with the orifices 126 and 128 having the same diameter and orifice 124 being somewhat larger in diameter. The orifices 124, 126 and 128 are oriented collinearly along the length of the centerline of the plate, with the orifices 124 in the plates 114 positioned substantially at the center of the plate, the first set of orifices 26 positioned on each side of and equidistant from the orifice 24, and the second set of orifices 28 positioned further yet from the orifice 24 and likewise equidistant there from. The outer mounting plates 116 have four matching orifices 126 and 128 formed therein, with the orifices 126 and 128 having the same diameter. The orifices 126 and 128 are oriented to match the holes H4 and H5 when the plates 114 and 116 are properly positioned over the sidewall W of the bucket A as shown.

Each of the slide plates 118 has a large keyhole orifice 130 positioned substantially in the center of the plate in a longitudinal orientation, and a single smaller circular orifice 132 on each side of the keyhole orifice 130. Each of the keyhole orifices 130 has a large circular head 134 of the same diameter as the large circular orifices 124 in the mounting plates 114, and a narrower linear slot 136 extending longitudinally or laterally away from the head 134. For each of the slide plates 118, the head 134, the linear slot 136 and the orifices 132 are all oriented collinearly along the length of the centerline of the plate, and the head 134 of the keyhole orifice 130 is oriented to align with the circular orifices 124 of the mounting plates 114 when the handle assembly 100 is fully assembled as shown. The smaller orifices 130 are oriented to align with the first set of smaller orifices 126 of the mounting plates 114 and 116 when the handle assembly 100 is fully assembled as shown.

The handle 112 has a uniform, round cross-section, is replaceable on the bucket A, and is made from metal stock such as ⅜" (three eighths inch) aluminum rod. The handle 112 includes a generally "V" shaped central portion 138, and two matching attachment ends 140 that extend radially and coaxially in a horizontal fashion away from opposing sides of the central portion 138. A radial detent or groove G is formed near the distal end of each attachment end 140.

Each end of the handle 112 is removably mounted to the inner surface of the sidewall W of the bucket A using a matching set of each of the inner and outer mounting plates 114 and 116. The mounting plates 114 and 116 are positioned on each side of the sidewall W over their corresponding holes H4 and H5, and fastened together with sets of screws 120 and nuts 122, with the sidewall W sandwiched between the mounting plates 114 and 116 and the holes H4 and H5 aligned with their corresponding orifices 124 of both plates. Preferably, the holes H4 and H5 are positioned such that the upper end of the mounting plates 114 and 116 rest against, but do not extend above, the outer lip of the rim R when the handle assembly 100 is fully assembled as shown.

When the handle assembly 100 is property assembled on the bucket A as shown in FIGS. 5-7, the distal ends of the attachment ends 140 are inserted through their respective orifices 134 and 124 in the mounting plates 114 and the slide plates 118 inside the sidewall W. The handle 112 has a length that is slightly less than the inner diameter of the sidewall W of the bucket A, such that the handle 112 will extend fully across the interior of the bucket A and abut at each end the inner surface of the sidewall W. The groove G at each end of the handle 112 is positioned to align with the edge of the slide plate 118 that defines the linear slot 136 when the attachment end 140 abuts the inner surface of the sidewall W through the orifice 134 of the slide plate 118 and the orifice 124 of the inner mounting plate 114. Thus, there is no need for the handle 112 to penetrate the sidewall W as in the first embodiment 10.

When the handle 112 is thus oriented in the bucket A, the slide plate 118 is positioned over the inner mounting plate 114 with the head 134 of the keyhole orifice 132 aligned with the end of the attachment end 140 and the linear slot 136 in a horizontal orientation. The slide plate 118 is then pressed against the inner mounting plate 114 such that the linear slot 136 of the keyhole orifice 132 aligns with the groove G in the attachment end 140 against the outer surface of the inner mounting plate 114. It will be noted that with the plates in this position, the orifices 130 will not align with the orifices 126 and holes H4. Instead, it is necessary to slide the slide plate 118 laterally over the groove G until the orifices 130 do align with the orifices 126 and the holes H4. Sets of screws 120 and nuts 122 are then used to secure the slide plate 118 to the inner mounting plate 114 as shown. As can be appreciated, this configuration firmly secures the handle 112 to the bucket A, while allowing the handle 112 to rotate relatively freely about the axis defined by the attachment ends 140 and the orifices 124 and 134.

A third representative embodiment of the novel bucket handle assembly of the present invention is shown generally at 200 in FIGS. 8-11, where the present invention is depicted by way of example incorporated into a bucket A. The bucket A can be any type of bucket or pail, so long as the sidewall W is somewhat pliant, such as for example a 5 gallon plastic pail such as those used for cleaning exterior windows of multi-story buildings, and which can be attached to scaffolding to facilitate such use.

This third representative embodiment the bucket handle assembly 200 comprises a generally cylindrical handle 212 with a first attachment end 214, a second attachment end 216 opposite the first attachment end 214, the handle 212 being shaped by a number of bends. The handle 212 has a uniform, round cross-section, is replaceable on the bucket A, and is made from metal stock such as ⅜" (three eighths inch) aluminum rod. A first bend 218 at the center of the handle 212 has an inner angle of approximately 135 degrees and divides the handle 212 into two mirrored halves. On one side of the first bend 218, a second bend 220 with an inner angle of approximately 145 degrees is positioned approximately one third of the distance from the first bend 218 to the first attachment end 214. A third bend 222 with a reverse angle of approximately 115 degrees is positioned approximately one inch from the first attachment end 214. On the other side of the bend 218 is a fourth bend 224 with an inner angle of approximately 145 degrees positioned opposite and mirroring the second bend 220. Similarly, a fifth bend 226 with a reverse angle of approximately 115 degrees is positioned approximately one inch from the second attachment end 216 and opposite and mirroring the third bend 222. Further, the entire handle 212 is planar. That is, all of the bends 218, 220, 222, 224 and 226 reside in a single plane.

As can be seen, the length of the handle 212 spanning from the third bend 222 and the first attachment end 214 and the length of the handle 212 spanning from the fifth bend 226 and the second attachment end 216 are coaxial. In this way, the handle 212 rotates about the axis between the first attachment end 214 and the second attachment end 216.

Figure 8:
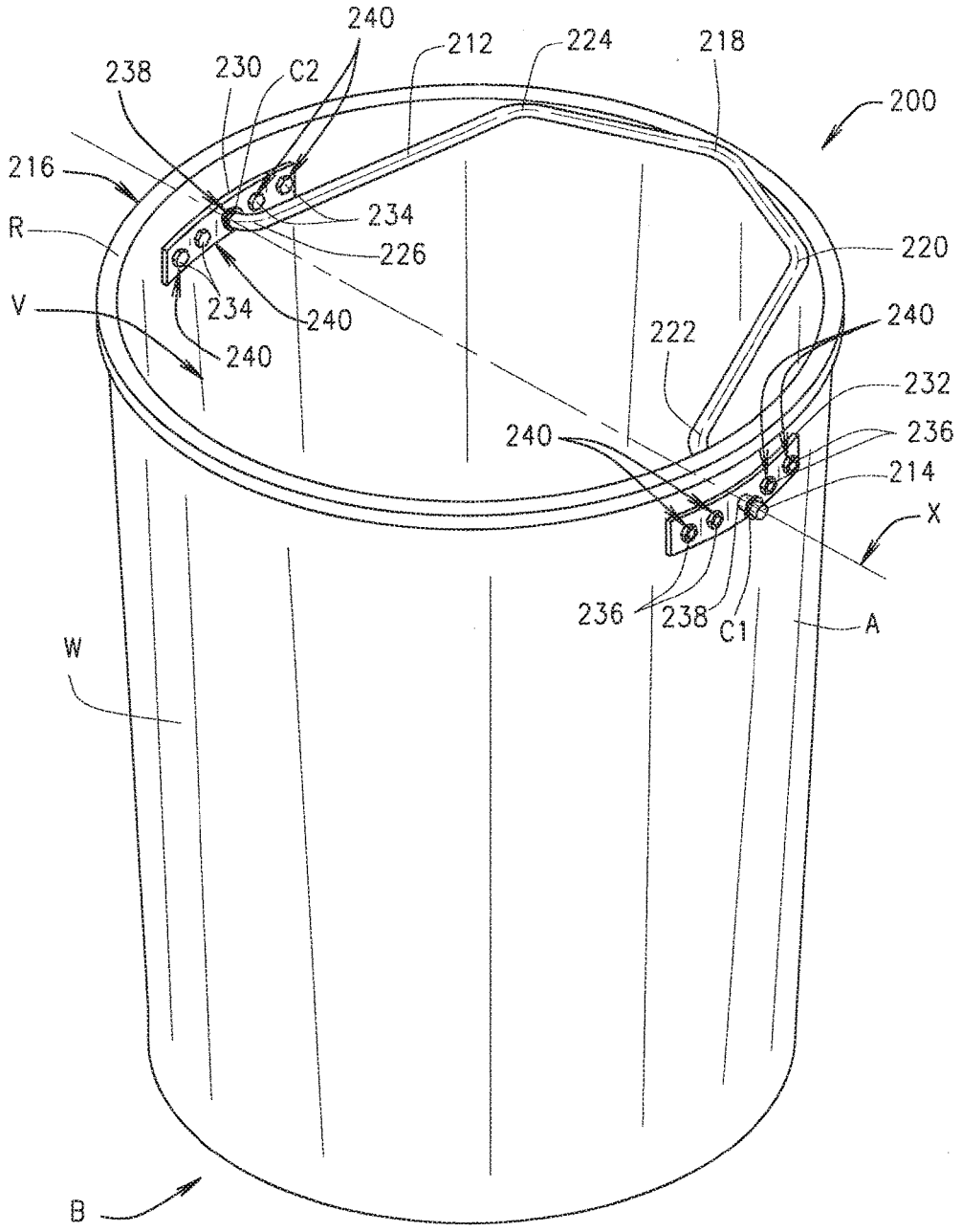
FIG. 8 is a perspective view of a third representative embodiment of the bucket handle and handle assembly of the present invention incorporated into a bucket, showing the handle rotated to a position with the upper end of the handle resting atop the upper lip of the bucket.

The handle assembly 200 also includes two identical inner mounting plates 230, two matching identical outer mounting plates 232, and eight sets of screws 234 and matching nuts 236 for securing the plates together and to the sidewall W of the bucket A when assembled (see FIG. 8). Each of the mounting plates 230 and 232 has a large circular orifice 238 positioned at the longitudinal center of the plate, and two smaller circular orifice 240 on each side of the central orifice 238. The orifices 238 and 240 of each of the inner mounting plates 230 are positioned to mate with corresponding orifices 238 and 240 of each of the outer mounting plates 232. Five horizontal holes H (generally, not shown) are formed in the sidewall W of the bucket A just below the rim R, and correspond to and mate with the orifices 238 and 240 of each of the mounting plates 230 and 232. When the mounting plates 230 and 232 are positioned on the sidewall W of the bucket A and aligned with the holes H, the screws 234 and nuts 236 secure the mounting plates 230 and 232 to opposing sides of the sidewall W as shown.

Figure 11:
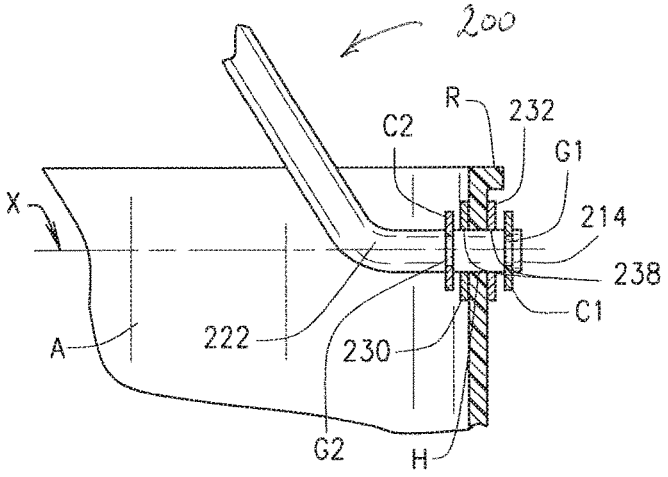
FIG. 11 is a partial cutaway plan view of one end of the third representative embodiment of the bucket handle and handle assembly of FIG. 8 incorporated into a bucket.

As best shown in FIG. 11, a first radial groove G1 and a parallel second radial groove G2 are formed near the distal end of the first attachment end 214, between the first attachment end 214 and the third bend 222. The distance between the grooves G1 and G2 is wider than the thickness of the sidewall W of the bucket A. The grooves G1 and G2 are sized and shaped as receptacles for a first "C" clip C1 and a second "C" clip C2, respectively, the clips C1 and C2 being sized and shaped to fit snugly yet releasably in the first groove G1 and second groove G2, respectively. Of course other retainer fittings, such as for example "E" clips or slot clips, can be used instead of "C" clips. As can be seen, when attaching the first attachment end 214 of the handle 212 to the sidewall W, the first attachment end 214 is extended from the inside of the bucket A through the large circular orifice 238 of inner mounting plate 230 and outer mounting plate 232, and matching hole H in the sidewall W just below the rim R with the first groove G1 positioned near the inner surface of the sidewall W and the second groove G2 positioned near the outer surface of the sidewall W. The first clip C1 is then snapped into the first groove G1 and the second clip C2 is then snapped into the second groove G2. In this way, the distal portion of the handle 212 in proximity to the first attachment end 214 is held in place in the sidewall W by the clips C1 and C2, yet is able to rotate with little or no resistance within the hole H. Notably, however, the distance between the clips C1 and C2 is greater than the combined thicknesses of the inner mounting plate 230, the outer mounting plate 232 and the sidewall W, such that a degree of "play' exists between the clips C1 and C2 and the sidewall W is free to slide inward and outward along the second attachment end 214 between the clips.

Although not shown in detail in the Figures, a matching pair of radial grooves G3 and G4 are likewise formed near the distal end of the second attachment end 216. The grooves G3 and G4 are sized and shaped as receptacles for a third "C" clip C3 and a fourth "C" clip C4, respectively, the clips C3 and C4 being sized and shaped to fit snugly yet releasably in the third groove G3 and fourth groove G4, respectively. Of course other retainer fittings, such as for example "E" clips or slot clips, can be used instead of "C" clips. As with the first and second grooves G1 and G2, when attaching second attachment end 216 of the handle 212 to the sidewall W, the second attachment end 216 is extended from the inside of the bucket A through the large circular orifice 238 of inner mounting plate 230 and outer mounting plate 232, and matching hole H in the sidewall W just below the rim R with the third groove G3 positioned near the inner surface of the sidewall W and the fourth groove G4 positioned near the outer surface of the sidewall W. The third clip C3 is then snapped into the third groove G3 and the fourth clip C4 is then snapped into the fourth groove G4. In this way, the distal portion of the handle 212 in proximity to the second attachment end 216 is held in place in the sidewall W by the clips C3 and C4, yet is able to rotate with little or no resistance within the hole H. Notably, again, the distance between the clips C3 and C4 is greater than the combined thicknesses of the inner mounting plate 230, the outer mounting plate 232 and the sidewall W, such that a degree of "play' exists between the clips C3 and C4 and the sidewall W is free to slide inward and outward along the second attachment end 216 between the clips.

Figure 9:
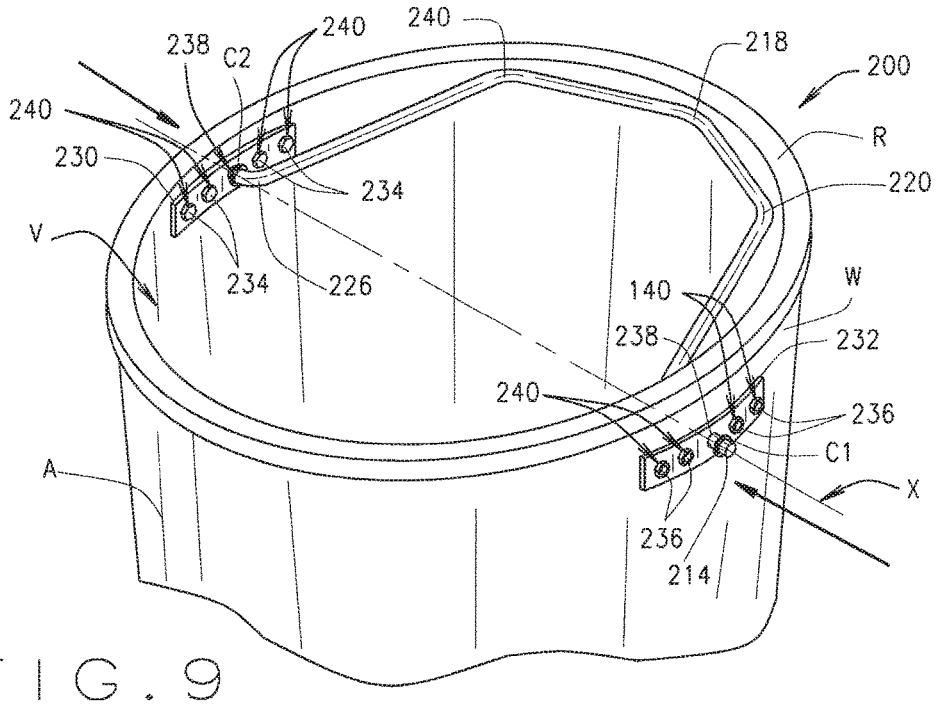
FIG. 9 is a perspective view of the third representative embodiment of the bucket handle and handle assembly of FIG. 8 incorporated into a bucket, showing the sides of the bucket being squeezed inwardly and the upper end of the handle rotated to a position just below the upper lip or rim of the bucket.
Figure 10:
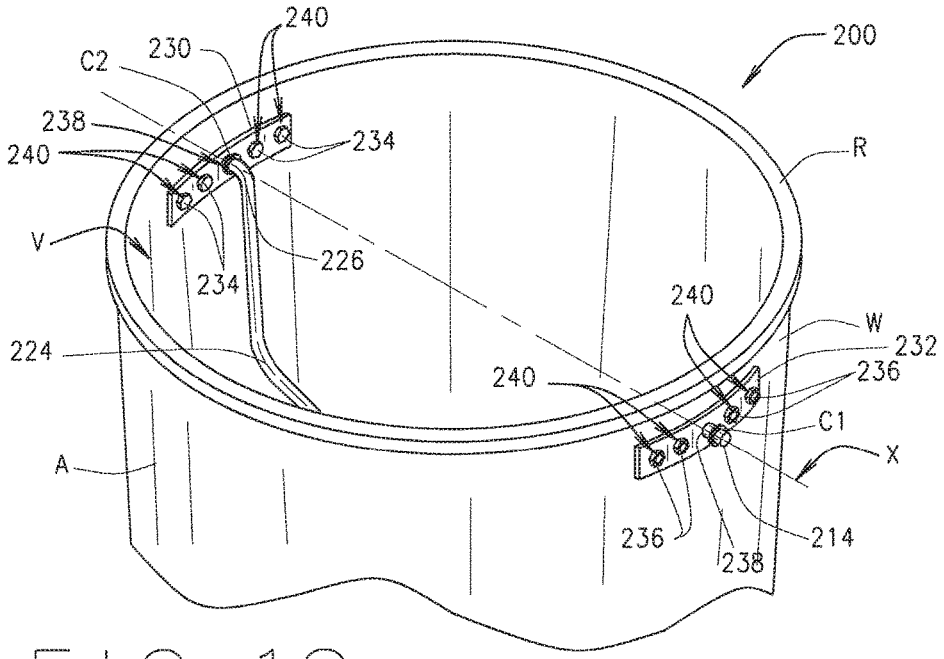
FIG. 10 is a perspective view of the third representative embodiment of the bucket handle and handle assembly of FIG. 8, showing the handle rotated to a position inside the body of the bucket, with the sides of the bucket no longer being squeezed.

Referring now to FIGS. 8-10, a unique capability of the handle assembly 200 of the present invention is illustrated. First, when the center of the handle assembly 200, at the first bend 218, is resting atop the rim R of the bucket A as depicted in FIG. 8, the handle 212 is unable to rotate about the axis X below the rim R. Thus, at least a portion of the handle assembly 200 is held in a position above the rim R for ready access during use, and the handle assembly 200 is unable to drop into the body of the bucket A where the handle 212 could otherwise fall into or contaminate materials being carried by the bucket A. This position of the handle assembly 200 also prevents the securing of a lid to the rim R, which has a substantially round shape. However, by squeezing the sidewall W on each side of the bucket A in proximity to the holes H, as depicted in FIG. 9, the rim R distorts from its round shape to form an elliptical shape that is elongated generally perpendicular to the axis X. It will be appreciated that the "play" afforded the sidewall W between the clips C1 and C2 and between C3 and C4 allows the sidewall W to be compressed in proximity to the attachment ends 214 and 216 of the handle 212. The handle 212 can then rotate past the rim R as shown. Finally, as depicted in FIG. 10, once it has rotated such that the bend 218 has passed the area of the sidewall in proximity to the rim R, the pressure on the sidewall W can be released, the sidewall W can return to its relaxed condition and shape, and the handle 212 is then free to rotate into the body of the bucket A below the rim R.

As can be appreciated, a correlation exists between the extent to which the handle 212 overlaps the rim R and the degree to which the rim R can be distorted when the bucket A sidewall W is squeezed inward. That is, while the handle 212 must extend at least in part over at least part of the rim R when the rim R is in its relaxed state, the handle 212 can only extend beyond the rim R to a point where the maximum temporary distortion of the rim R is sufficient to allow the handle 212 to rotate below the rim R.

Figure 12:
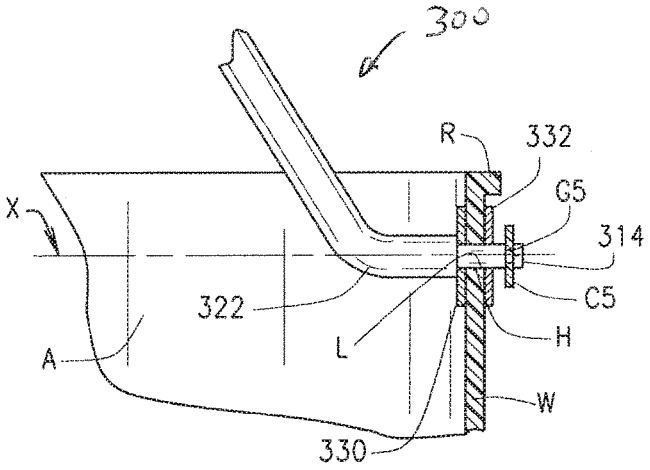
FIG. 12 is a partial cutaway plan view of one end of a fourth representative embodiment of the bucket handle and handle assembly of the present invention incorporated into a bucket.

A representative portion of a fourth embodiment 300 of the novel handle assembly of the present invention is shown at FIG. 12. In this alternate embodiment, instead of matching pairs of radial grooves, G1 and G2, and G3 and G4, formed in attachment ends of the handle having a uniform diameter (such as in the handle 212), each of the attachment ends 314 and 316 of the handle 312 are honed down to form a smaller diameter coaxial extension of the handle. It can be seen that between the third bend 322 and the first attachment end 314, the handle 312 has a step reduction in diameter. In fact, the location of this reduction in diameter along the handle 312 corresponds to the position of the first groove G1 in the first embodiment as seen in FIG. 11. Returning to FIG. 12, a circular and radial ledge L is formed at the location of the reduction in diameter, the ledge L facing away from the third bend 322 of the handle 312. A radial groove G5 is formed near the distal end of the handle 312, between the ledge L and the butt of the first attachment end 314.

The groove G5 is sized and shaped as a receptacle for a "C" clip C5, the clip C5 being sized and shaped to fit snugly yet releasably in the groove G5. Of course other retainer fittings, such as for example "E" clips or slot clips, can be used instead of "C" clips. The distance between the ledge L and the clip C5 is slightly wider than the thickness of the sidewall W of the bucket A, such that a degree of "play' exists between the clip C5 and the ledge L, and the sidewall W is free to slide inward and outward along the first attachment end 314 between the clip C5 and the ledge L.

As can be seen, when attaching the first attachment end 314 of the handle 312 to the sidewall W, the first attachment end 314 is extended from the inside of the bucket A through the large circular orifice 338 of inner mounting plate 330 and outer mounting plate 332, and matching hole H in the sidewall W just below the rim R with the ledge L positioned near or against the inner surface of the sidewall W and the groove G5 positioned near the outer surface of the sidewall W. The clip C5 is then snapped into the groove G5. In this way, the distal portion of the handle 312 in proximity to the first attachment end 314 is held in place in the sidewall W by the clips C1 and C2, yet is able to rotate with little or no resistance within the hole H.

Figure 13:
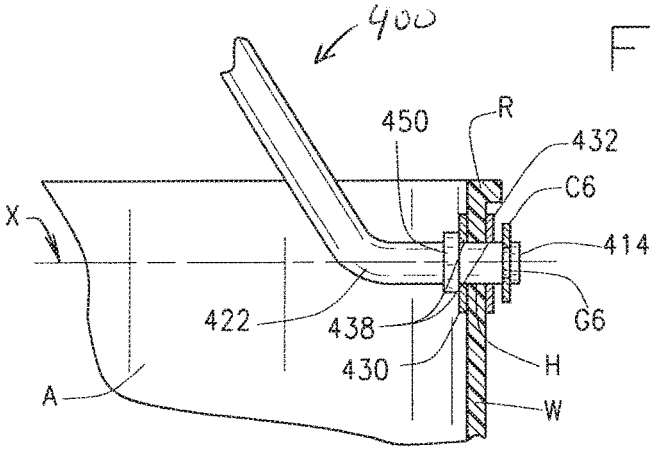
FIG. 13 is a partial cutaway plan view of one end of a fifth representative embodiment of the bucket handle and handle assembly of the present invention incorporated into a bucket.
Figure 14:
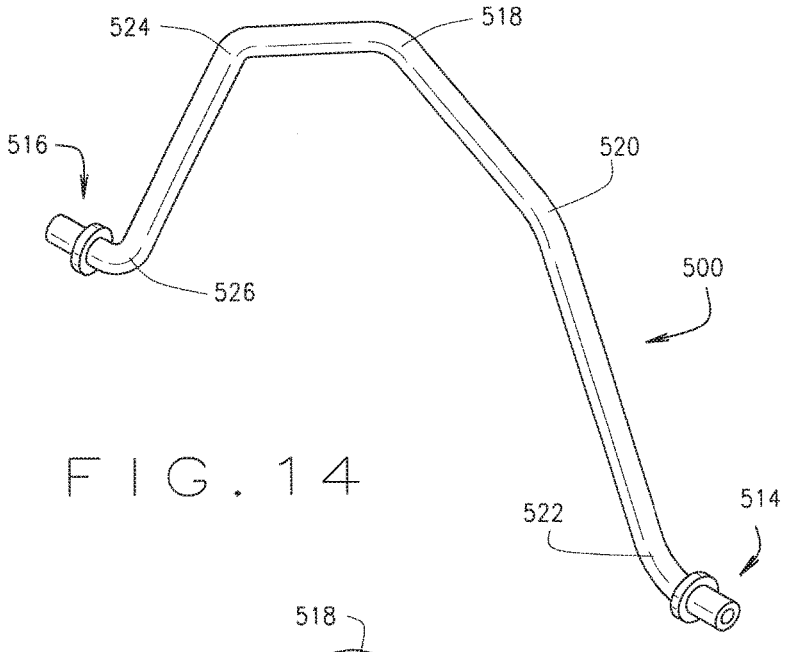
FIG. 14 is a perspective view of a sixth representative embodiment of the bucket handle of the present invention.
Figure 15:
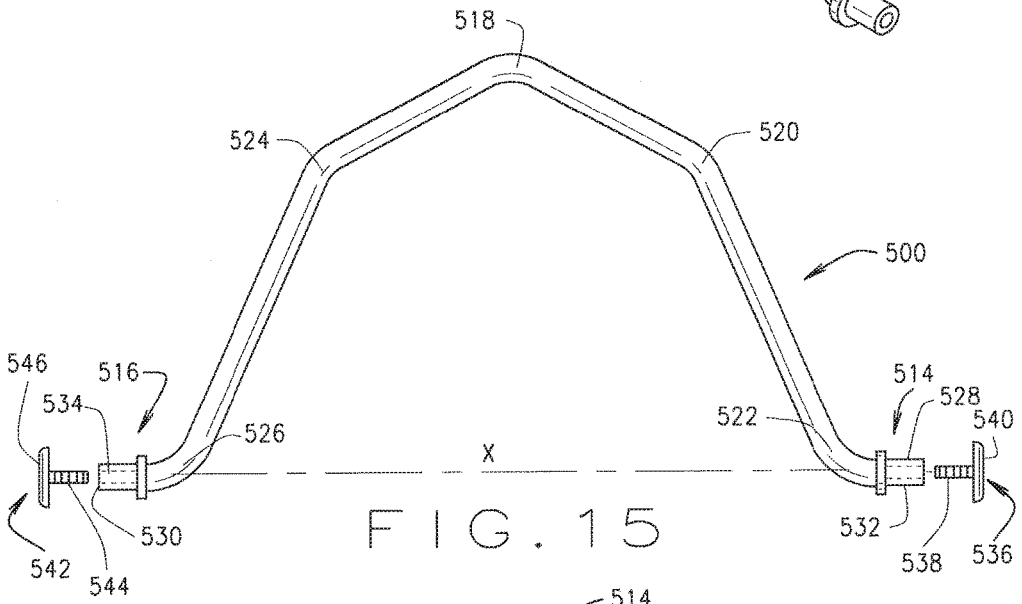
FIG. 15 is a plan view of the sixth representative embodiment of the bucket handle of FIG. 14 with securing screws shown at each end.
Figure 16:
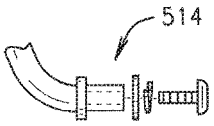
FIG. 16 is an exploded plan view of one end of the sixth representative embodiment of the bucket handle of FIG. 14 with a securing screw and associated washers.

A representative portion of a fifth embodiment of the novel handle assembly of the present invention is shown at 400 in FIG. 13. In this alternate embodiment, as compared to the first embodiment of FIGS. 8-11 and 12, the radial groove G1 is replaced with a circular or radial brace 450 encircling and rigidly attached to the handle 412. The brace 450 must have a diameter sufficient to prevent the handle 412 and brace 450 from passing through the large circular orifice 438 of inner mounting plate 430 and outer mounting plate 432, and matching hole H. Of course, the brace 450 need not fully circumnavigate the handle 412, but need only comprise one or more protrusions that extend beyond the circumference of the handle 412 such that the handle 412 and brace 450 will not pass through the large circular orifice 438 of inner mounting plate 430 and outer mounting plate 432, and matching hole H.

A sixth embodiment of the novel handle of the present invention is shown at 500 in FIGS. 14-18. In this alternate embodiment, the handle 500 has a first attachment end 514, a second attachment end 516 opposite the first attachment end 514, the handle 500 being shaped by a number of bends. The handle 512 has a uniform, round cross-section, is replaceable on the bucket A, and is made from metal stock such as ⅜" (three eighths inch) aluminum rod. A first bend 518 at the center of the handle 512 has an inner angle of approximately 135 degrees and divides the handle 500 into two mirrored halves. On one side of the first bend 518, a second bend 520 with an inner angle of approximately 145 degrees is positioned approximately one third of the distance from the first bend 518 to the first attachment end 514. A third bend 522 with a reverse angle of approximately 115 degrees is positioned approximately one inch from the first attachment end 514. On the other side of the bend 518 is a fourth bend 524 with an inner angle of approximately 145 degrees positioned opposite and mirroring the second bend 520. Similarly, a fifth bend 526 with a reverse angle of approximately 115 degrees is positioned approximately one inch from the second attachment end 516 and opposite and mirroring the third bend 522. Further, the entire handle 500 is planar. That is, all of the bends 518, 520, 522, 524 and 526 reside in a single plane.

The first attachment end 514 and the second attachment end 516 are coaxial about a common central axis X. The first attachment end 514 terminates in a flat face 528 perpendicular to the axis X. Likewise, the second attachment end 516 terminates in a flat face 530 perpendicular to the axis X. A threaded orifice 532 extends inward from the face 528 into the first attachment end 514 along the axis X. Similarly, a threaded orifice 534 extends inward from the face 530 into the second attachment end 516 along the axis X. Hence, the handle 500 can rotate about the axis X at the first and second attachment ends 514 and 516.

A screw 536 releasably attaches to the threaded orifice 532 in the first attachment end 514. A washer and lock washer for the screw 536 are shown as additional components in FIGS. 16 and 18. The screw 536 has a threaded shank 538 that matches the threaded orifice 532 and a broad flat bottom cap 540 that is wider than the first attachment end 514. The screw 536 is sized to thread fully into the orifice 532. A screw 542 releasably attaches to the threaded orifice 534 in the second attachment end 516. The screw 542 has a threaded shank 544 that matches the threaded orifice 534 and a broad flat-bottom cap 546 that is wider than the second attachment end 516. The screw 542 is sized to thread fully into the orifice 534.

A circumferential plate or stop 548 and extends radially from the side of the first attachment end 514 approximately half-way between the third bend 522 and the face 528. The distance between the stop 548 and the head 540 of the screw 536 when fully engaged with the first attachment end 514 is slightly wider than the thickness of the sidewall W of the bucket A, such that a degree of "play' exists between the stop 548 and the head 540 of the screw 536, and the sidewall W is free to slide inward and outward along the first attachment end 514 between the stop 548 and the head 540 of the screw 536. Similarly, a circumferential plate or stop 550 and extends radially from the side of the second attachment end 516 approximately half-way between the fifth bend 526 and the face 530. The distance between the stop 550 and the head 546 of the screw 542 when fully engaged with the second attachment end 516 is slightly wider than the thickness of the sidewall W of the bucket A, such that a degree of "play' exists between the stop 550 and the head 546 of the screw 542, and the sidewall W is free to slide inward and outward along the first attachment end 514 between the stop 550 and the head 546 of the screw 542.

Figure 17:
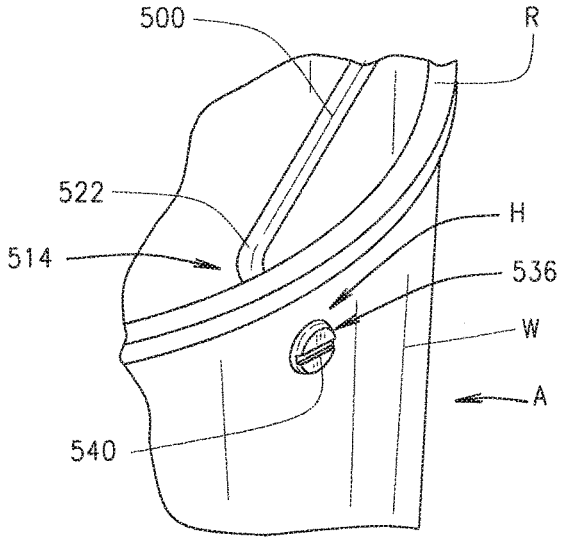
FIG. 17 is perspective view of one end of the sixth representative embodiment of the bucket handle of FIG. 14 shown mounted into the sidewall of a bucket and secured with a screw.
Figure 18:
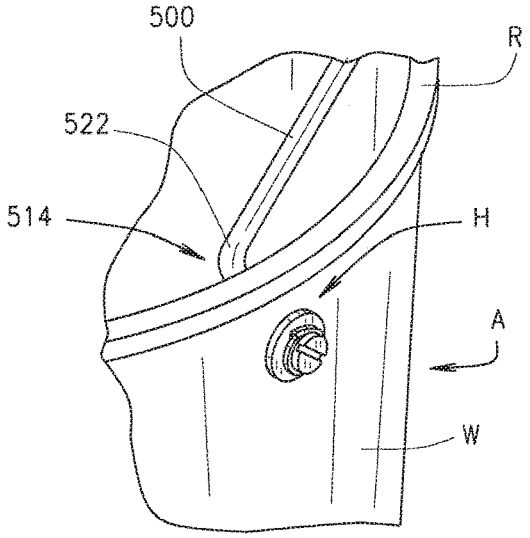
FIG. 18 is perspective view of one end of the sixth representative embodiment of the bucket handle of FIG. 14 shown mounted into the sidewall of a bucket and secured with a screw and associated washers.

Referring to FIG. 17, it can be seen that the first attachment end 514 extends through a hole H in the sidewall W of the bucket A near the rim R. The hole H is sized to rotatably and slidably receive the first attachment end 514, but not the stop 548 nor the head 540 of the screw 536. Hence, when the attachment end 514 is thrust into the hole H from inside the bucket A, the extent of travel by the first attachment end 514 through sidewall W will be limited by the stop 548 and only part of the first attachment end 514 will extend through the sidewall W. The screw 536 screws into the orifice 532 to secure the first attachment end 514 to the sidewall W of the bucket A in the hole H. As can be appreciated, the second attachment end 516 attaches to the sidewall W of the bucket A in a similar manner (not shown).

As can be appreciated, the length of the handle 500 spanning from the third bend 522 and the first attachment end 514 and the length of the handle 512 spanning from the fifth bend 526 and the second attachment end 516 are coaxial. In this way, the handle 500 rotates about the axis between the first attachment end 514 and the second attachment end 516.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel mechanisms of the present invention, shown by way of example at 10, 100, 200 300, 400 and 500 can be arranged in a number of other and related varieties of configurations without departing from or expanding beyond the scope of my invention as set forth in the claims. Hence, it will be apparent to those skilled in the art that various changes and modifications can be made in the novel bucket handle and handle assembly without departing from the scope of the invention.

For example, it is not necessary that the mounting plates 14 and 16, 114 and 116, 214 and 216, 314 and 316, 414 and 416, 514 and 516, and the slide plates 18, 118, 218, 318, 418 and 518, and the slide plates 18 and 118, have a particular shape or thickness or size such as the curved rectangular shapes depicted in the disclosed embodiments, so long as each performs its intended function of securing the handle to the sidewall W of the bucket A as disclosed.

Further, it is not necessary that the mounting plates 14 and 16, 114 and 116, 230 and 232, 330 and 332, 430 and 432, and the slide plates 18 and 118 be secured to each other and the sidewall W of the bucket A by a specific set of four screws and nuts, such as the screws 20, 120 and 234 and the nuts 22, 122 and 236. Rather, the mounting plates and slide plates can be secured by as few as a single screw with or without a nut, or by various other types fasteners well known in the art, including for example clamps, cotter pins, welds, various glues and adhesives, rivets and brads.

By way of further example, while the depictions of the handle assembly 200 show first bend 218 in the handle 212 resting atop the rim R in FIG. 8, the handle 212 can be shaped in a wide variety of configurations an yet achieve the goals of the present invention. That is, the handle 212 can take on many shapes and dimensions so long as the handle 212 remains substantially rigid, at least one or more portions of the handle 212 overlaps at least in part the rim R when the handle assembly 200 is properly attached to the bucket A and the rim R is in a relaxed state, and so long as those one or more portions can rotate into the body of the bucket A when the sidewall W is compressed or squeezed to elongate the rim R. Such shapes and dimensions can include, for example, a generally rectangular shape, a smooth curve with lugs or protrusions that overlap the rim R, or a collection of bumps, curve or sharp angles with portions that overlap the rim R. Further, the handle 212 need not be planar, but can be multi-planar and can have hooks, arms and other extensions that extend into various dimensions. Also, the handle assembly 200 need not be constructed of rod, so long as the handle 212 is substantially rigid and shaped to rotate within the bucket A substantially as disclosed. That is, instead of a cylindrical rod with dimensions disclosed above, the handle 212 can be constructed for example of a rectangular bar, a formed or machined plate, various types of tubing, or other variety of rigid stock material.

In addition, while the sixth embodiment depicts (see FIGS. 17-18) that the fastener or screw 536 attaches to the attachment end directly against the sidewall W, it is contemplated that the handle 500 can be used in conjunction with one or more mounting plates or other reinforcement for the sidewall W, such as for example the mounting plates 14 and 16 depicted in FIGS. 1-7 or the various mounting plates in FIGS. 8-13. Further, it is contemplated that the fastener or screw configuration of the sixth embodiment of the handle 500 can be incorporated into various of the first through fifth configurations by replacing the outer slide plates 18 (FIGS. 1-3) or the outer clips (FIGS. 8-13) with the fastener or screw adaption shown in FIGS. 14-18.

Additional variations or modifications to the configuration of the novel mechanism of the present invention may occur to those skilled in the art upon reviewing the subject matter of this disclosure. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention. Accordingly, all matter contained in the above description or shown in the accompanying drawings should be interpreted as illustrative and not in a limiting sense.

What is claimed is:

1. A handle for a bucket, the bucket having a base with a perimeter and a pliant sidewall extending upward from the base, the sidewall being pliant and defining a pliant rim opposite the base, the rim having a top facing away from the base, the sidewall having an inner surface on the inside of the bucket and an outer surface opposite the inner surface, the base and sidewall defining a cavity in the bucket, the bucket having a first attachment region positioned on the inner surface of the sidewall near the rim and a second attachment region positioned on the inner surface of the sidewall near the rim, the second attachment region being separated from the first attachment region, the sidewall having a relaxed condition and a laterally compressed condition, the laterally compressed condition occurring when compressive force is applied to opposing sides of the sidewall in proximity to the first and second attachment regions to reduce the distance between said attachment regions by a predetermined length, the relaxed condition occurring when no forces are applied to the bucket, the handle comprising:

a. an elongated and substantially rigid central portion;

b. a substantially rigid first attachment end extending laterally from the central portion and terminating at a first axis, the first axis being perpendicular to the first attachment region of the bucket, the first attachment end attaching rotatably about the first axis to the first attachment region such that the central portion rotates about the first axis at the first attachment region, the first attachment end adapted to allow the sidewall to move laterally along the first axis relative to the first attachment end when the first attachment end is attached to the first attachment region; and c. a substantially rigid second attachment end extending laterally from the central portion in a direction different from the first attachment end, the second attachment end attaching rotatably to a second attachment region of the inner surface of the sidewall near the rim, the second attachment region being separated from the first attachment region;

wherein the central portion of the handle has a first rotational position about the first axis in which the central portion is positioned substantially above the rim of the bucket and a second rotational position about the first axis in which the central portion is positioned substantially below the rim of the bucket, the handle being shaped and sized such that the central portion of the handle is unable to rotate between the first and second rotational positions when the sidewall is in its relaxed condition but is able to rotate between the first and second rotational positions when the sidewall is in its laterally compressed condition.

2. The handle of claim 1, wherein the bucket comprises a first orifice in the sidewall at the first attachment region, the first attachment end being shaped and sized to slide longitudinally within and rotate about the first axis within said first orifice.

3. The handle of claim 2, further comprising an inner stop positioned between the central portion and the first attachment end, said inner stop being shaped and sized to terminate at the inner stop inward longitudinal travel within the first orifice by the first attachment end.

4. The handle of claim 2, further comprising an outer stop in proximity to the outer extremity of the first attachment end, said outer stop being shaped and sized to terminate at the outer stop outward longitudinal travel within the first orifice by the first attachment end.

5. The handle of claim 1, wherein the second attachment end extends from the central portion opposite the first attachment end and terminates at a second axis, the second axis being perpendicular to the second attachment region, the second attachment end attaching rotatably about the second axis to the second attachment region, the second attachment end adapted to allow the sidewall to move laterally along the second axis relative to the second attachment end when the second attachment end is attached to the second attachment region.

6. The handle of claim 5, wherein the first axis and the second axis are coaxial.

7. The handle of claim 5, further comprising a fastener that attaches the second attachment end to the second attachment region of the sidewall of the bucket.

8. The handle of claim 5, wherein the bucket comprises a first orifice in the sidewall at the first attachment region, and the first attachment end slides into and rotates about the first axis within said first orifice, and the bucket comprises a second orifice in the sidewall at the second attachment region and the second attachment end slides into and rotates about the second axis within said second orifice.

9. The handle of claim 1, further comprising a fastener that attaches the first attachment end to the first attachment region of the sidewall of the bucket.

10. The handle of claim 1, further comprising a protrusion extending from the central portion of the handle, the protrusion preventing the central portion of the handle from rotating between the first and second rotational positions when the sidewall is in its relaxed condition but allowing the central portion to rotate between the first and second rotational positions when the sidewall is in its laterally compressed condition.

11. The handle of claim 1, wherein the bucket sidewall has a known pliability and the handle is shaped and sized to correspond to said sidewall pliability such that the central portion of the handle is unable to rotate between the first and second rotational positions when the sidewall is in its relaxed condition but is able to rotate between the first and second rotational positions when the sidewall is in its laterally compressed condition.

* * * * *